US010996009B2

(12) United States Patent
Coombs et al.

(10) Patent No.: US 10,996,009 B2
(45) Date of Patent: May 4, 2021

(54) CARTRIDGE MAGAZINE

(71) Applicant: Amend 2, LLC, Idaho Falls, ID (US)

(72) Inventors: Colby Coombs, Idaho Falls, ID (US); Matthew Bellitti, Idaho Falls, ID (US); Ryan Cowgill, Idaho Falls, ID (US)

(73) Assignee: Amend2, LLC, Idaho Falls, ID (US)

( * ) Notice: Subject to any disclaimer, the term of this patent is extended or adjusted under 35 U.S.C. 154(b) by 0 days.

(21) Appl. No.: 16/867,189

(22) Filed: May 5, 2020

(65) Prior Publication Data

US 2020/0386498 A1 Dec. 10, 2020

Related U.S. Application Data

(63) Continuation of application No. 16/400,297, filed on May 1, 2019, now Pat. No. 10,655,924.

(60) Provisional application No. 62/665,086, filed on May 1, 2018.

(51) Int. Cl.
*F41A 9/69* (2006.01)

(52) U.S. Cl.
CPC ..... *F41A 9/69* (2013.01)

(58) Field of Classification Search
CPC ..... F41A 9/65; F41A 9/61; F41A 9/67; F41A 9/69
See application file for complete search history.

(56) References Cited

U.S. PATENT DOCUMENTS

| | | | | |
|---|---|---|---|---|
| 1,833,862 | A | 11/1931 | Schmeisser | |
| 2,594,237 | A * | 4/1952 | Wallenhorst | F41A 9/65 42/18 |
| 3,399,480 | A | 9/1968 | Rowe, Jr. | |
| 4,472,900 | A * | 9/1984 | Howard | F41A 9/69 42/50 |
| 4,672,760 | A | 6/1987 | Chesnut | |
| 5,099,595 | A * | 3/1992 | Chesnut | F41A 9/69 42/50 |
| 8,448,364 | B2 * | 5/2013 | Davidson | F41A 9/70 42/50 |
| 9,255,749 | B2 * | 2/2016 | Faifer | F41A 9/65 |
| 9,506,706 | B2 * | 11/2016 | Higley | F41A 9/65 |
| 9,857,132 | B2 * | 1/2018 | Ballard | F41A 9/70 |
| 10,161,698 | B2 * | 12/2018 | Nakayama | F41A 9/70 |
| 10,415,910 | B1 * | 9/2019 | Zukowski | F41A 9/69 |
| 10,655,924 | B2 | 5/2020 | Coombs et al. | |
| 2016/0025436 | A1 * | 1/2016 | Higley | F41A 9/65 42/49.01 |

(Continued)

FOREIGN PATENT DOCUMENTS

| | | | | |
|---|---|---|---|---|
| DE | 1094155 B | * 12/1960 | | F41A 9/65 |
| DE | 1094155 B | 12/1960 | | |

(Continued)

*Primary Examiner* — Benjamin P Lee
(74) *Attorney, Agent, or Firm* — Travis R. Banta; TechLaw Ventures, PLLC

(57) ABSTRACT

A cartridge magazine is provided. The cartridge magazine may include a rib mounted on a vertical wall of the cartridge magazine. The cartridge may further include a ramp attached to a top of the rib. In another embodiment, the cartridge magazine may include an opening including spacer having a flat portion. The flat portion provides space for a cartridge of a particular caliber between the flat portion of the spacer and an opposing wall of the cartridge magazine.

20 Claims, 7 Drawing Sheets

(56) References Cited

U.S. PATENT DOCUMENTS

2018/0058784 A1* 3/2018 McCormick ..... F41A 9/65

FOREIGN PATENT DOCUMENTS

| | | | | | |
|---|---|---|---|---|---|
| DE | 3422334 | A1 | * | 12/1985 | ..... F41A 9/69 |
| DE | 3422334 | A1 | | 12/1985 | |
| GB | 377840 | A | * | 8/1932 | ..... F41A 9/69 |

* cited by examiner

SECTION A-A

SECTION A-A

CARTRIDGE MAGAZINE

CROSS-REFERENCE TO RELATED APPLICATIONS

This application claims priority to and the benefit of U.S. Provisional Application No. 62/665,086, filed May 1, 2018, and U.S. Pat. No. 10,655,924, filed on May 1, 2019 which are both incorporated herein by reference in its entirety, including but not limited to those portions that specifically appear hereinafter, the incorporation by reference being made with the following exception: In the event that any portion of the above-referenced provisional application is inconsistent with this application, this application supersedes said above-referenced provisional application.

BACKGROUND

Development of an ammunition cartridge, which contained all the components necessary to fire a projectile from a firearm in one object, revolutionized firearms technology. Ammunition cartridges include a metallic case, preferably brass, fitted to accept a primer of an appropriate size, gunpowder, and a projectile. More commonly, a cartridge is referred to as a "bullet" even though the projectile, the bullet, is but one element of an ammunition cartridge. One of the reasons for this clarification is that ammunition cartridges are made in different sizes. For example, a brass case may be a particular size, provide a primer pocket for receiving a primer of a particular size, have an internal volume of a specific size to receive gun powder, and may further accept a bullet of a particular size. Ammunition cartridges are typically referred to by distinguishing characteristics of the cartridge. For example, cartridges that include bullets that are .22 inches in diameter (e.g., .22 caliber) are typically referred to as "twenty twos."

One problem with this nomenclature is that there are a number of different .22 caliber ammunition cartridges. Thus, these other cartridges are combined with another word to uniquely identify the specific cartridge being referred to. For example, 22 Short, 22 Long, 22 Long Rifle (which is typically referred to and understood as the "twenty two"), 223 Remington, 220 Swift, are all .22 caliber bullets although the dimensions of the brass case require differences in the guns that will chamber these various rounds. Accordingly, other nomenclatures have been developed to refer to a particular .22 caliber. For example, one person may explain to another that a particular rifle is a 22 Short which means that a 22 Long Rifle cartridge will not fit in the rifle because of the differences in a size of the casing associated with the round (the 22 Long Rifle implements a physically longer case than a 22 Short).

To further complicate matters, commonly known and understood terms in the United States may also have international designations, which are typically identified in millimeters. For example, a 5.56 mm bullet is a .223 caliber bullet. With relatively minor differences, any firearm that accepts a 5.56 mm NATO cartridge will also accept a .223 Remington cartridge (but not necessarily the other way around). Hundreds, if not thousands of different cartridges have been developed for a host of different uses. Many of these cartridges are derivatives of other more "standard" cartridges. A "standard" cartridge is typically one that has been used by a military as a general issue caliber or refers to a cartridge that has been standardized by Sporting Arms and Ammunition Manufacturers' Institute (SAAMI). Examples of standard cartridges may include 5.56×45 mm NATO (223 Remington in the United States), 30-06 Springfield, 7.62×51 mm (NATO—which in the United States is referred to as a 0.308, 7.62×39 (developed by the former Soviet Union), 9 mm, 45 ACP, and a number of others. Wildcatters, as they are known, are people who experiment on different caliber cartridges to examine the ballistics of each cartridge they have developed. Several "wildcat" cartridges have been developed into readily available cartridges today.

One difficult aspect of wildcat cartridges is that standard calibers, case dimensions, primer types, gunpowder loads, and etc. are not readily available to other shooters. Thus, only the very best wildcat cartridges become standardly available cartridges, frequently because the ballistics of a particular wildcat cartridge surpass what is currently available in standard cartridges. Many of these wildcat cartridges are "necked down" versions of standard cartridges. A necked down cartridge is one that was originally meant for a larger bullet but whose neck size has been reduced to accept a smaller bullet. For example, the 7.62×39 case has been necked down (among other changes) to accept a 6.5 mm bullet, to make a cartridge known as a 6.5 Grendel. Other examples of necked down cartridges include the 220 Swift (a necked down 6 mm Lee Navy), any of the cartridges known as "short magnums," 17 HMR, 270 Winchester, 243 Winchester, and a host of others.

Cartridges, however, are only one aspect of successfully firing a projectile into a target. A firearm must be developed to fire each specific cartridge and include a chamber which virtually identically accepts the outer dimensions of the cartridge while also providing a barrel that matches the dimensions of the bullet. This can be a challenging feat based on the "neck angle" of the cartridge. The "neck angle" is the taper of a neck of a case from the body up to the top of the case. A wider body with a smaller bullet, results in a more tapered neck angle while a narrower body with a bigger bullet results in less neck angle. In necked down cartridges, neck angle can be a substantial problem not only in ensuring a cartridge fits in a chamber of a firearm but also in ensuring cartridges can be fed into the chamber of the firearm. SAAMI typically defines and accepts standard dimensions for wildcat cartridges to become a standardly accepted cartridge.

Militaries, around the world, also perform ballistics research on new rounds that are developed for military use. Both cartridges and firearms are developed to "military specifications," which is more commonly known as "milspec." Milspec and SAAMI standards may not be identical in every case, although since many SAAMI standards were developed from military rounds, many milspec and SAAMI standards are identical.

Modern sporting rifles, also known as "Armalite Rifles" or "AR" rifles are typically built to military specifications. AR rifles are highly desirable because they are highly customizable to meet a shooter's particular interests and needs. Thus, the parts for AR rifles are perfectly interchangeable regardless of what manufacturer developed the part, so long as the parts are built to milspec standards. The AR rifle includes a number of parts, such parts referred to as an "upper," a "lower," and a "barrel." For manufacturers, it is undesirable to manufacture any parts for a modern sporting rifle that are not interchangeable with parts made by other manufacturer because the shooting public simply will not buy non-standardized parts.

An AR lower contains the trigger for the rifle and accepts magazines for feeding cartridges with bullets into the AR upper which are fired through the barrel. Thus, magazines must also be built to be milspec (e.g., have appropriate dimensions to feed into a milspec AR lower). However, since the advent of the AR style rifle in 1959, modern shooting enthusiast have developed AR style rifles in different calibers, again to meet the needs of a particular shooting application for a particular person. Initially, the AR-5, AR-10, and AR-15 rifles were developed which fired a 22 Hornet cartridge, a 308 (7.62×51 NATO) cartridge, and a 223 Remington (5.56×45 NATO) cartridge. Since then, AR style rifles have been chambered to use a large number of other cartridges. However, it has been a substantial challenge to develop magazines that reliably feed ammunition in to certain AR implementations. One particularly difficult problem has been in developing milspec magazines for necked down calibers, particularly in non-metallic magazines.

Metallic magazines have been developed for use with AR style rifles which index each cartridge in the magazine based on the bottom of the case or on the body of the case but forgo many of the benefits of a non-metallic magazine. However, many non-metallic magazines typically index each cartridge in the magazine on the neck of the case which, with necked down cases has been a significant problem.

It is, therefore, one object of this disclosure to provide a cartridge magazine that provides a milspec cartridge magazine. It is another object of this disclosure to provide a milspec cartridge magazine that reliably feeds necked down cartridges into an AR style rifle. It is a further object of this disclosure to provide a cartridge magazine that is a milspec, non-metallic, and reliably feeds necked down cartridges into an AR style rifle.

SUMMARY OF THE DISCLOSURE

Disclosed herein is a cartridge magazine. The cartridge magazine may include a rib mounted on a vertical wall of the cartridge magazine. The cartridge may further include a ramp attached to a top of the rib.

Also disclosed herein is a cartridge magazine. The cartridge magazine may include an opening including spacer having a flat portion. The flat portion provides space for a cartridge of a particular caliber between the flat portion of the spacer and an opposing wall of the cartridge magazine.

BRIEF DESCRIPTION OF THE DRAWINGS

Non-limiting and non-exhaustive implementations of the disclosure are described with reference to the following figures, wherein like reference numerals refer to like parts throughout the various views unless otherwise specified. Advantages of the disclosure will become better understood with regard to the following description and accompanying drawings where.

DETAILED DESCRIPTION

The disclosure extends to cartridge magazines which may be used with various types of firearms including modern sporting rifles, automatic rifles, semi-automatic rifles, and other firearms.

In the following description of the disclosure, reference is made to the accompanying drawings, which form a part hereof, and in which is shown by way of illustration specific implementations in which the disclosure is may be practiced. It is understood that other implementations may be utilized and structural changes may be made without departing from the scope of the disclosure.

In the following description, for purposes of explanation and not limitation, specific techniques and embodiments are set forth, such as particular techniques and configurations, in order to provide a thorough understanding of the device disclosed herein. While the techniques and embodiments will primarily be described in context with the accompanying drawings, those skilled in the art will further appreciate that the techniques and embodiments may also be practiced in other similar devices.

Reference will now be made in detail to the exemplary embodiments, examples of which are illustrated in the accompanying drawings. Wherever possible, the same reference numbers are used throughout the drawings to refer to the same or like parts. It is further noted that elements disclosed with respect to particular embodiments are not restricted to only those embodiments in which they are described. For example, an element described in reference to one embodiment or figure, may be alternatively included in another embodiment or figure regardless of whether or not those elements are shown or described in another embodiment or figure. In other words, elements in the figures may be interchangeable between various embodiments disclosed herein, whether shown or not.

Figure 1:
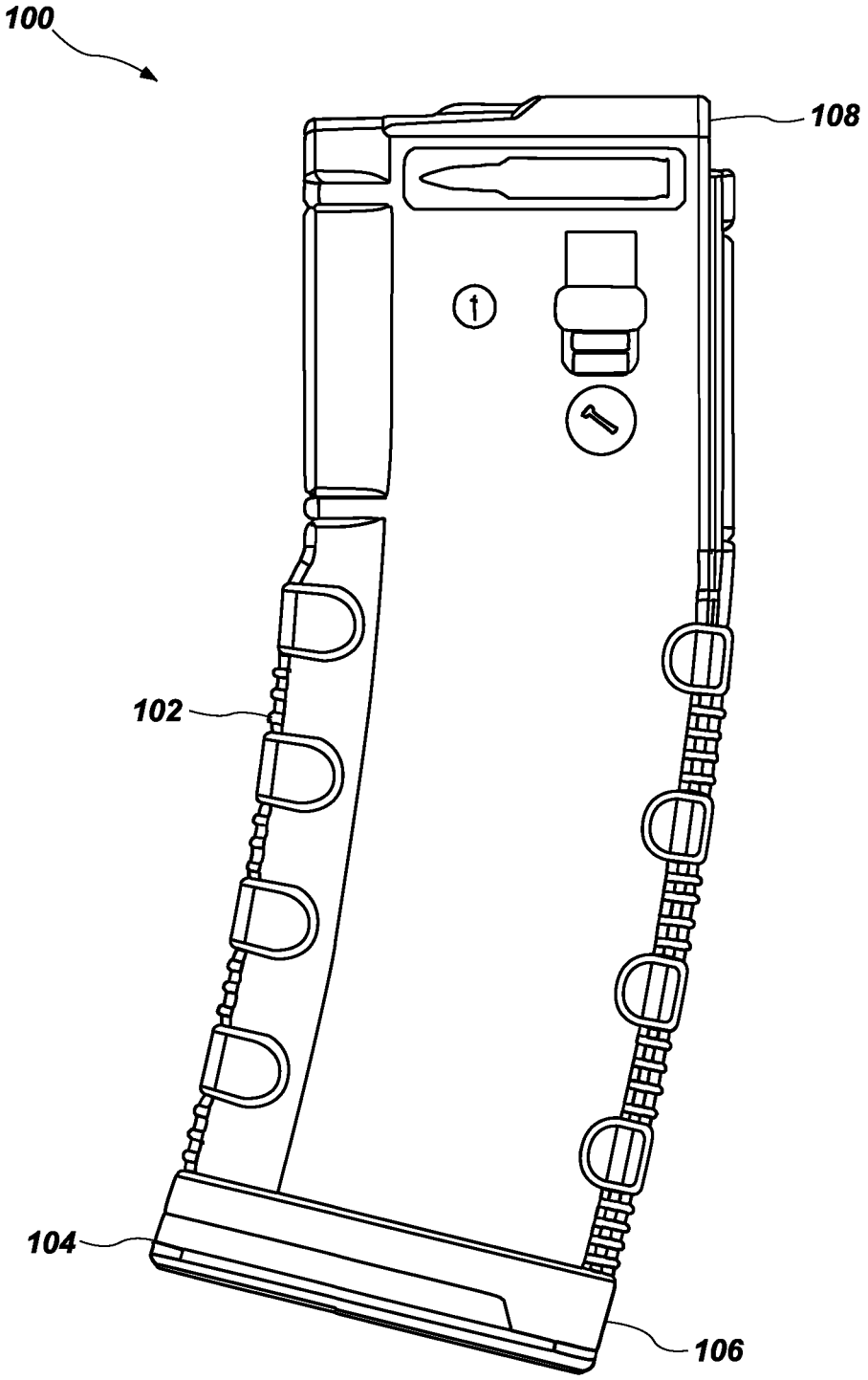
FIG. 1 illustrates a fully assembled cartridge magazine.

FIG. 1 illustrates a fully assembled cartridge magazine 100. Cartridge magazine 100 includes a housing 102 and a floorplate 104. Floorplate 104 slideably engages housing 102 along a bottom end 106 of housing 102 to remove internal components or cartridges from inside cartridge magazine 100. Ammunition cartridges (not shown in this view) may be loaded into cartridge magazine 100 via top end 108 of housing 102.

Housing 102 and floorplate 104 may be constructed in many different ways known by those of ordinary skill, and may be formed of a plastic material using molding processes, or alternatively may be formed of a metal or other material, using techniques and processes known to persons of ordinary skill.

Figure 2:
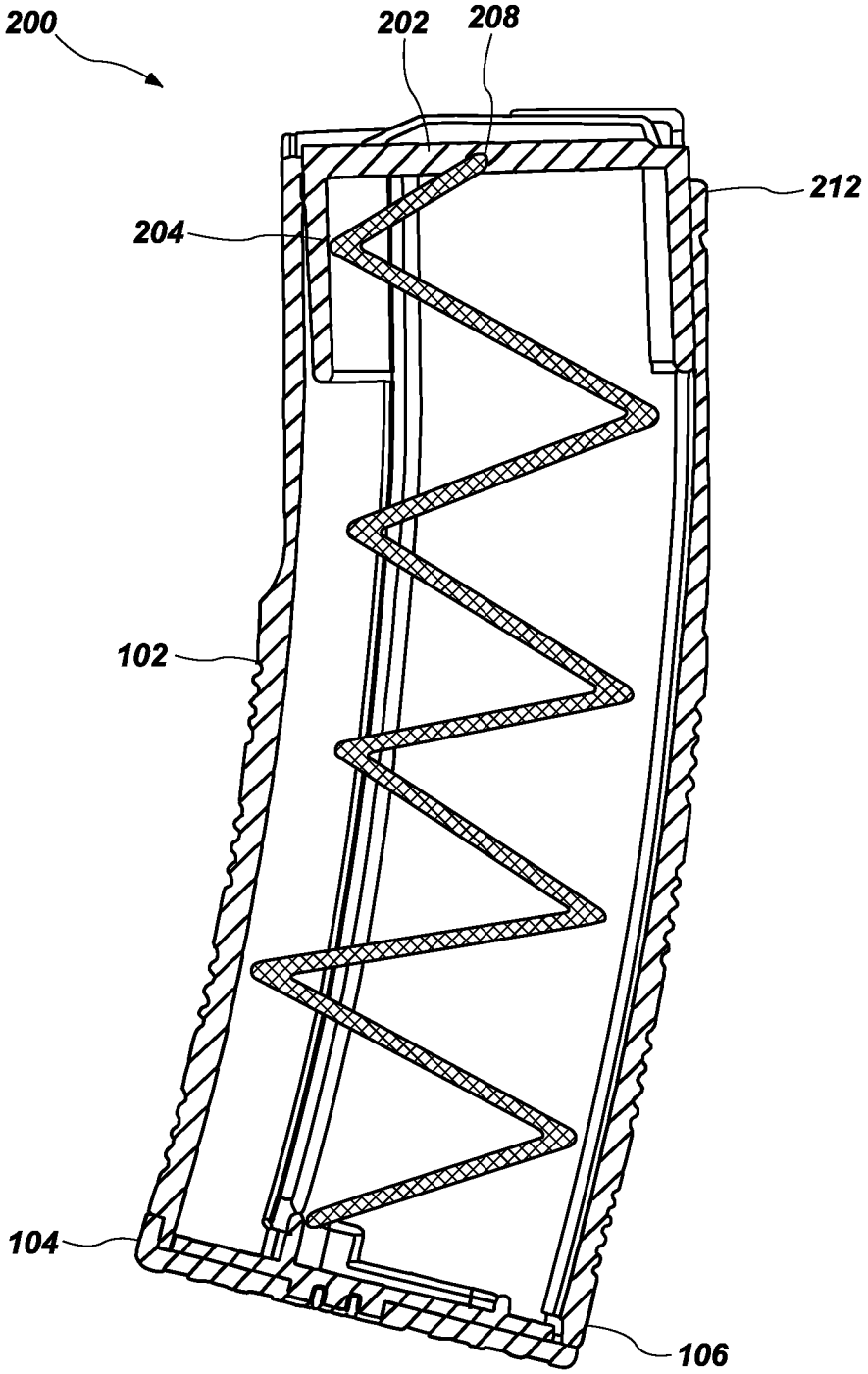
FIG. 2 illustrates a vertical cut away view of an unloaded cartridge magazine.

FIG. 2 illustrates a vertical cut away view of an unloaded cartridge magazine 200. As shown in FIG. 1 and FIG. 2 together, cartridge magazine 200 includes a housing 102 and a floorplate 104 as previously seen in cartridge magazine 100 depicted in FIG. 1, but further includes follower 202, spring 204 and spring retainer 206.

In one embodiment, follower 202 is removably secured to a top end 208 of spring 204 and spring retainer 206 is removably secured to a bottom end of spring 204, thus forming a spring assembly including the three components of follower 202, spring 204 and spring retainer 206. Spring 204, when properly installed within housing 102, will be, in one embodiment, partially compressed, thus exerting a pushing spring force on spring retainer 206 which respectively causes an extruded portion 210, i.e. an extrusion, of spring retainer 206 to interlock with a corresponding cutout portion of floorplate 104, thus locking the floorplate in place. In one embodiment, spring 204 is partially compressed only after one or more ammunition cartridges are loaded into cartridge magazine 200.

A recess corresponding with extruded portion 210 within floorplate 104 is designed to allow the extruded portion of spring retainer 206 to pass completely through floorplate 104, securing the floorplate to cartridge magazine 200. In one embodiment, spring retainer 206 may provide extruded portion 210 on a bottom side which interlocks with floorplate 104. Extruded portion 210 may act as a button, functionally speaking, and may be formed in a fanciful shape, letter, number, or as information identifying a characteristic of cartridge magazine 200 (e.g., a caliber of cartridge magazine 200).

In one embodiment, cartridge magazine 200, during assembly, includes follower 202 of the spring assembly formed by follower 202, spring 204 and spring retainer 206 first entering housing 102 through the bottom end 106 of housing 102 such that follower 202 slideably engages the interior of housing 102 and slides within a channel of housing 102 towards the top end 212 of housing 102 followed by two or more coils of spring 204 of the spring assembly, followed by spring retainer 206, with the top of spring retainer 206 oriented towards the top end 212 of housing 102, and the bottom of spring retainer 206 oriented towards the bottom end 106 of housing 102. Once the spring assembly is entirely within housing 102, typically through minor or moderate compression of spring 204, floorplate 104 slideably engages the bottom end 106 of housing 102 to capture the spring assembly therein so that the cutout portion of floorplate 104 interlocks with the extruded portion 210 of spring retainer 206 to hold floorplate 104 in place. This secures the spring assembly inside housing 102 and positions the indicia of the extruded portion 210 of spring retainer 206 so that it is visible from a viewpoint external to the cartridge magazine, typically through or at the cutout portion of floorplate 104.

Figure 3:
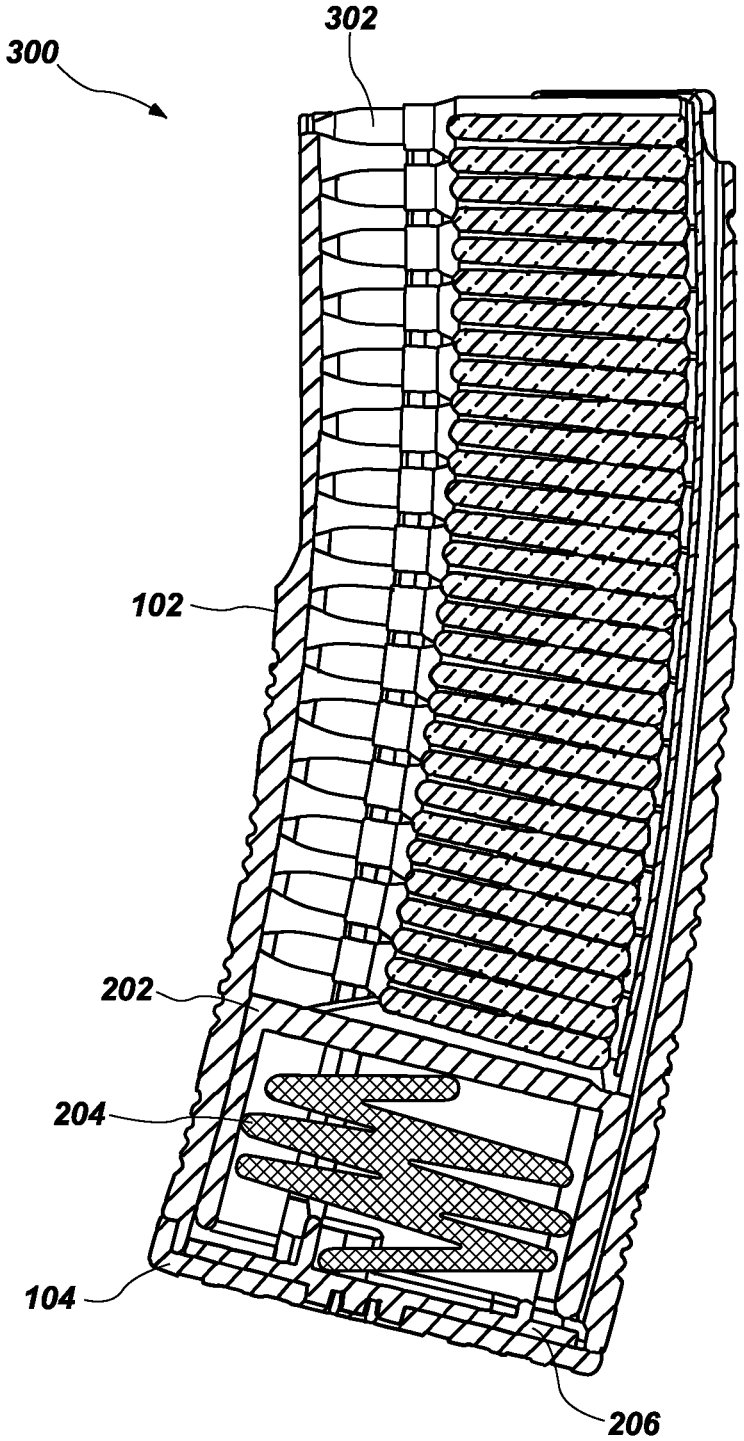
FIG. 3 illustrates a vertical cut away view of a loaded cartridge magazine.

FIG. 3 illustrates a vertical cut away view of a loaded cartridge magazine 300. As shown in FIG. 3, cartridge magazine 300 includes housing 102. Housing 102 includes a hollow channel (not visible due to perspective) within which the follower, spring and spring retainer are located, when the cartridge magazine is in its assembled form. To load the cartridge magazine with ammunition cartridges, such as ammunition cartridge 302, ammunition cartridge 302 is placed into position at the top of cartridge magazine 300 and pushed into cartridge magazine 300 in a manner that compresses spring 204. This spring compression pushes follower 202 into housing 102 and allows ammunition cartridge 302 to enter and be retained within housing 102. Clips extending from housing 102 secure ammunition cartridge 302 inside cartridge magazine 300 until removed by pushing the topmost cartridge 302 forward which releases the topmost cartridge from spring pressure from spring 204.

Figure 4:
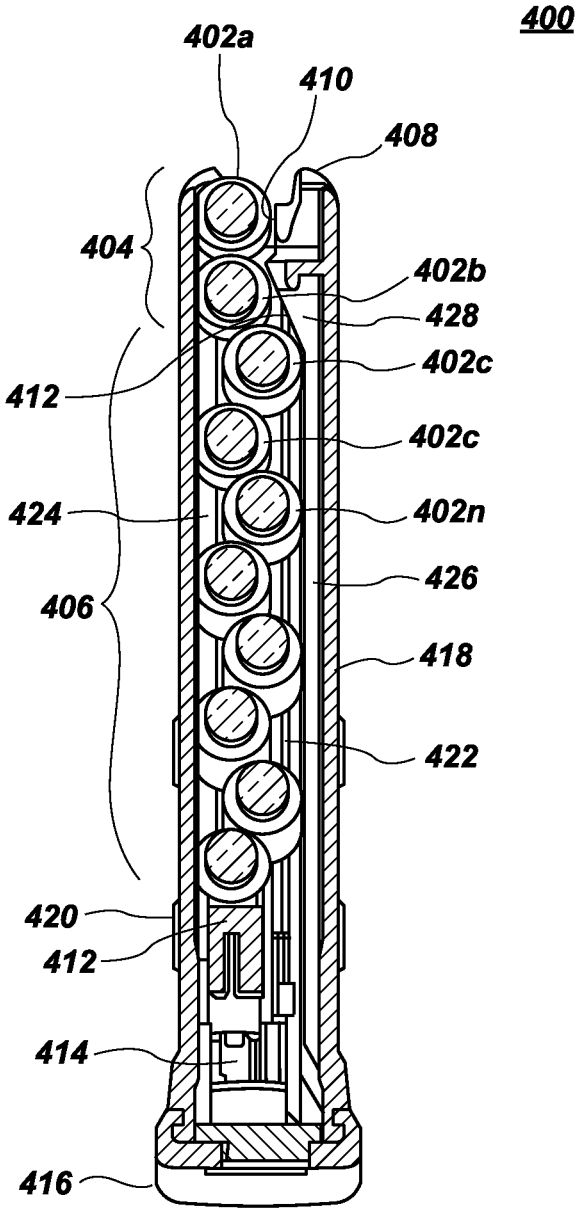
FIG. 4 illustrates a vertical cut away view from a front perspective of a cartridge magazine.

FIG. 4 illustrates a vertical cut away view from a front perspective of a cartridge magazine 400. Cartridge magazine 400 may be referred to as a hybrid type magazine because cartridge 400 employs two different types of cartridge stacking in a single magazine. As shown in FIG. 4, bullets 402*a* and 402*b* are arranged in a "single stack" configuration 404. So called "single stack" magazines refer to magazines where each cartridge is coplanar with every other magazine in the magazine. That is, each subsequent cartridge loaded in the magazine rests in-line and on top of each previous bullet. A "double stack" magazine provides a magazine where two cartridges are disposed virtually side-by-side such that a first column of cartridges are co-planar and in-line with others in the first column, while a second column of cartridges are co-planar and in line with others in the second column. As illustrated in FIG. 4, cartridges 402*c*-402*n* are arranged in a staggered, or offset, stack 406, which is similar to a double stack configuration with the exception that the cartridges shown in cartridge magazine are not side-by-side as in a double stack magazine. Rather, cartridges 402*c*-402*n* are arranged in a manner that is between a single stack and a double stack configuration, herein referred to as a staggered, or offset, stack 406. The staggered stack 406 will be discussed in more detail below. However, a staggered stack configuration includes successive ammunition cartridges stacked on top of each other where an angle of no greater than thirty degrees exists between a line drawn between the centers of a flat surface at the rear of the ammunition cartridges and an interior side wall of the cartridge magazine It is further noted that ten cartridges 402*a*-402*n* are shown in FIG. 4. However, any number of cartridges may be implemented using the techniques disclosed herein and is not limited to a particular number of cartridges within cartridge magazine 400. Cartridge magazine 400 may further be a milspec magazine for a modern sporting rifle platform.

As shown in FIG. 4, cartridges 402*a*-402*n* are shown with a bullet end of the cartridge forward with a forward wall of cartridge magazine 400 cut-away for explanatory purposes. Cartridge magazine 400 includes feed lips 408 which are provided in pairs and serve to retain cartridges 402*a*-402*n* within cartridge magazine 400. One of feed lips 408 may include a flat portion 410, arranged in parallel with a length of cartridge 402*a*, having a height that is equal to or less than the diameter of cartridge 402*a* and having a length that is less than a distance from a rim of cartridge 402*a* to a neck of cartridge 402*a*. In another embodiment, flat portion 410 may have a length that is less than half of the distance from a rim of cartridge 402*a* to a neck of cartridge 402*a*. Flat portion 410 may orient cartridge 402*a* to be readily moved from the magazine into a chamber of a firearm by the bolt of the firearm when cartridge magazine 400 is inserted into a firearm. As a bolt of the firearm moves forward, spring pressure provided by spring 414 pushes on follower 412 (and floorplate 416) to push cartridge 402*b* along flat portion 410 and cartridge 402*c* from the staggered stack 406 to a single stack 404 orientation. Cartridge magazine includes a right wall 418, a left wall 420, a rear wall 422, and a front wall (not shown) which are sized appropriately to contain and secure cartridges in the staggered stack 406 shown in FIG. 4.

For some cartridge calibers, a spacer 424 may be used to appropriately size cartridge magazine 400 to contain and secure certain cartridge calibers while also maintaining a milspec size for cartridge magazine 400. Thus, spacer 424 may be optional depending on caliber for cartridge magazine 400 and, when not installed, leave left wall 420 as a flat surface. Spacer 424 may direct or push cartridges 402*a*-402*n* towards right wall 418 and into rib 426. Rib 426 may be positioned on a vertical wall of cartridge magazine 400. As shown in FIG. 4, rib 426 is disposed on right wall 418 of cartridge magazine 400. As shown in FIG. 4, a single rib 426 is shown, although a plurality of ribs may be implemented in practice. Rib 426 may be positioned along a vertical wall of cartridge magazine 400 beginning at a base of the magazine or beginning below ramp 428 and extend vertically up and down cartridge magazine 400 to ramp 428.

Ramp 428 may be included at a top end of rib 426 or each one of ribs 426. Ramp 428 is set an angle to rib 426 such that a cartridge that encounters ramp 428 in cartridge magazine 400 is pushed from a staggered stack 406 to a single stack configuration 404. Accordingly, ramp 428 serves to transition cartridges 402*a*-402*n* from a staggered stack configuration 406 to a single stack configuration 404 within cartridge magazine 400.

In practice, a plurality of ribs 426 and ramps 428 may be spaced evenly along a vertical wall of cartridge magazine 400. Further, ribs 426 may extend from the vertical wall of cartridge magazine 400 from between a rim of a cartridge case and a neck of cartridge case such that each cartridge staggered to the side of cartridge magazine that includes ribs 426 contacts each rib along the case from between the rim of the cartridge case and the neck of the cartridge case (e.g., between a head and a shoulder of the cartridge case). A ramp 428 connected to the foremost rib 426 in cartridge magazine 400 may include a larger angle than other ramps 428 connected to other ribs 426 to accommodate constant contact with a shoulder of a cartridge case, such as cartridge case 402*c*, shown in FIG. 4.

Figure 5:
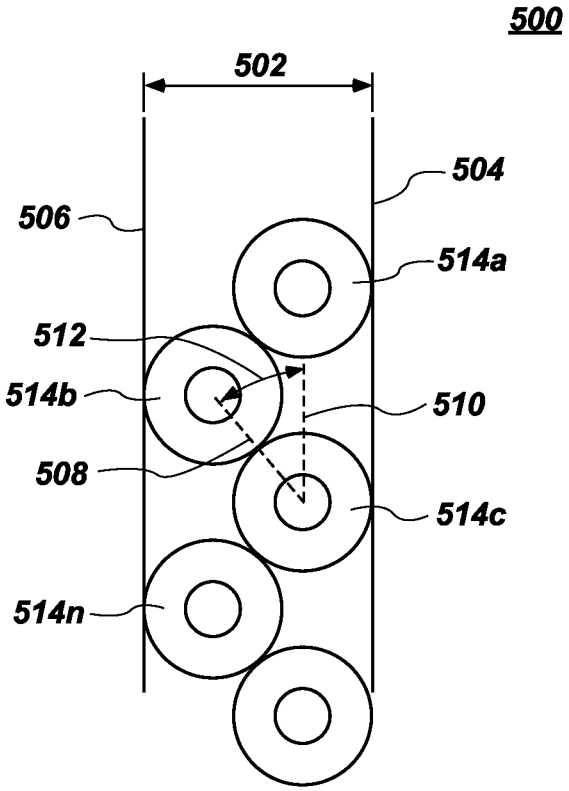
FIG. 5 illustrates a preferred stagger angle between cartridges in a cartridge magazine.

FIG. 5 illustrates a preferred stagger angle 512 between cartridges 514*a*-514*n* in a cartridge magazine 500. Cartridge magazine 500 may be similar to cartridge magazine 400 shown in FIG. 4 and/or any of cartridge magazines 100, 200, and 300 shown in FIGS. 1-3, each of which are described above. Cartridge magazine 500 may have a width 502 which contains cartridges between right wall 504 and left wall 506. In a staggered stack, as shown in FIG. 5 and discussed above, cartridges 514*a*-514*n* are offset from each other as opposed to being inline. In a staggered stack, as shown in FIG. 5, a center of cartridge 514*a* and a center of cartridge 514*c* may be inline as denoted by line 510 such that line 510 may be drawn through a center of a head of a brass case of a cartridge (e.g., through a center of a primer in a centerfire cartridge). However, a line 512 drawn between a center of cartridge 514*c* and a center of cartridge 514*b*, which cartridges are adjacent, may be disposed at an angle 512 away from line 510. Angle 512 may also be referred to as a stagger angle. Preferably angle 512 is 30 degrees or less so as to ensure reliable loading of cartridges from magazine 500 into a chamber of a firearm. Angle 512 may be dictated by a width 502 of cartridge magazine 500 which is a smallest interior distance between left side 506 and right side 504 of cartridge magazine 500.

Figure 6:
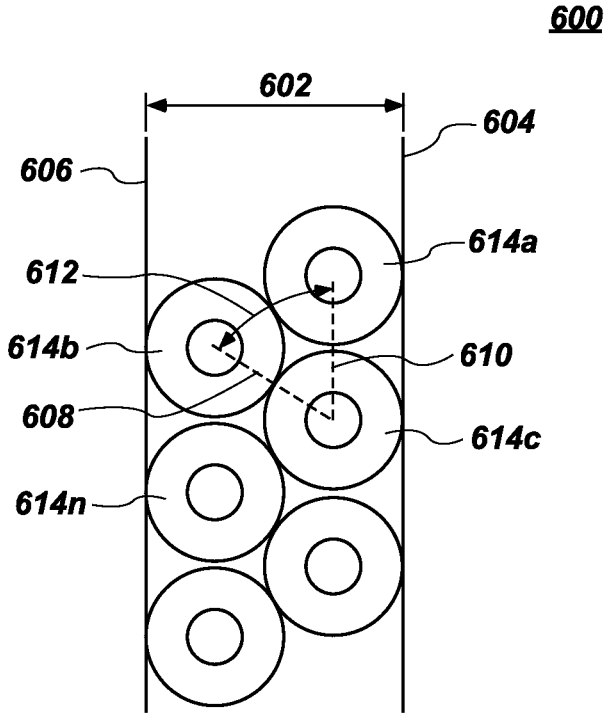
FIG. 6 includes another embodiment of a stagger angle between cartridges in a cartridge magazine.

FIG. 6 illustrates another embodiment of stagger angle 612 between cartridges 614*a*-614*n* in a cartridge magazine 600. Cartridge magazine 600 may be similar to cartridge magazine 400 shown in FIG. 4 and/or any of cartridge magazines 100, 200, 300, and 500 shown in FIGS. 1-3, and 5, each of which are described above. Cartridge magazine 600 may have a width 602 which contains cartridges between right wall 604 and left wall 606. In a staggered stack, as shown in FIG. 6 and discussed above, cartridges 614*a*-614*n* are offset from each other as opposed to being inline. FIG. 6 illustrates a heavily staggered stack which is similar, although different, from a double stack configuration in that, for example, cartridge 614*a* does not directly contact cartridge 614*c*. In a staggered stack, as shown in FIG. 6, a center of cartridge 614*a* and a center of cartridge 614*c* may be inline as denoted by line 610 such that line 610 may be drawn through a center of a head of a brass case of a cartridge (e.g., through a center of a primer in a centerfire cartridge). However, a line 612 drawn between a center of cartridge 614*c* and a center of cartridge 614*b*, which cartridges are adjacent, may be disposed at an angle 612 away from line 610. Angle 612 may also be referred to as a stagger angle. Angle 512 is about 60 degrees or less for loading cartridges from magazine 600 into a chamber of a firearm.

Angle 612 may be dictated by a width 602 of cartridge magazine 600 which is a smallest interior distance between left side 606 and right side 604 of cartridge magazine 600. It should be noted that any angle less than about 60 degrees is acceptable for a stagger angle 612 where about 60 degrees means with 6.66 degrees or within 10 degrees of 60 degrees. In another embodiment, less than about 50 or less degrees is acceptable for a stagger angle 612 or less than about 45 degrees or less is acceptable for a stagger angle 612. In another embodiment, about 40 degrees or less is acceptable for a stagger angle 612. In another embodiment, about 35 degrees or less is acceptable for a stagger angle 612. In another embodiment, about 25 degrees or less is acceptable for a stagger angle 612. In another embodiment, about 20 degrees or less is acceptable for a stagger angle 612. In another embodiment, about 15 degrees or less is acceptable for a stagger angle 612. In another embodiment, about 10 degrees or less is acceptable for a stagger angle 612. It is noted that a lower bound on embodiments of stagger angle are greater than zero degrees as a stagger angle 612 of zero degrees is a single stack configuration.

Figure 7:
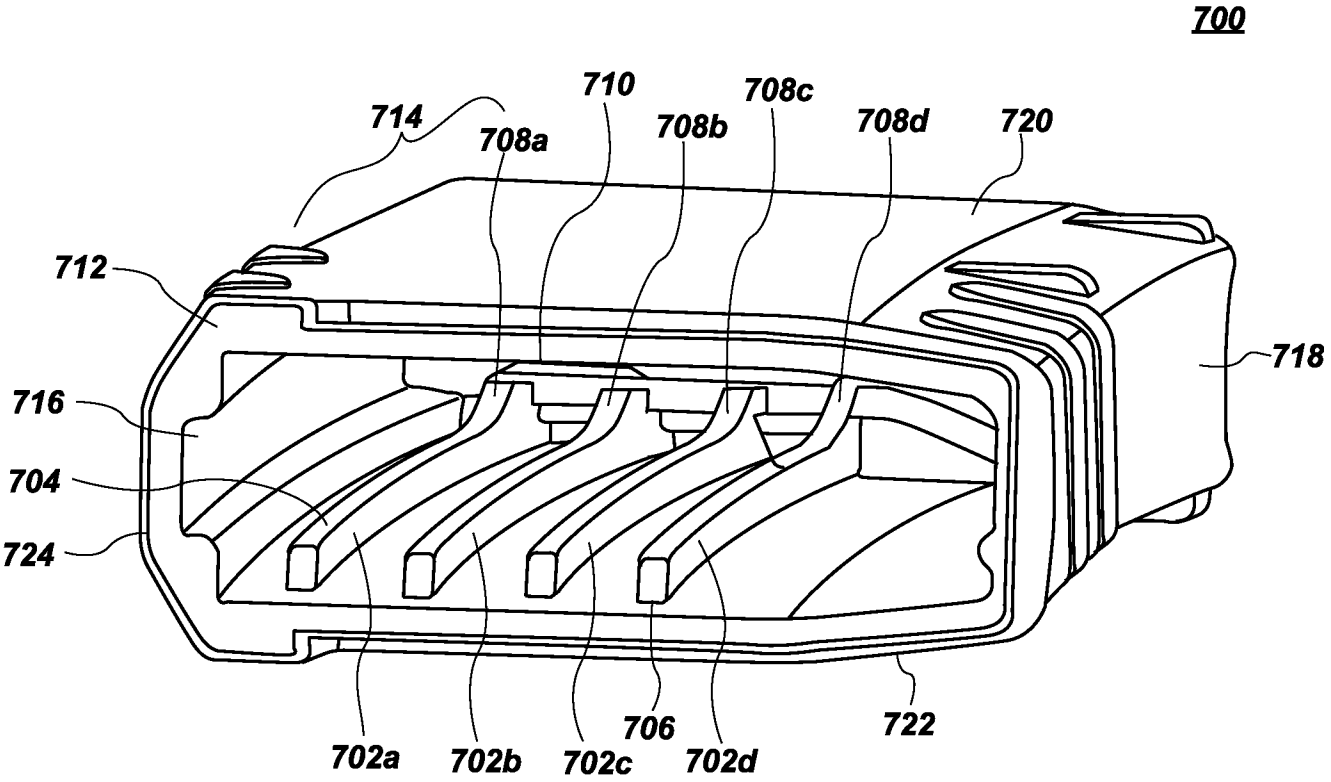
FIG. 7 illustrates a bottom perspective view of a cartridge magazine.

FIG. 7 illustrates a bottom perspective view of a cartridge magazine 700. Cartridge magazine 700 is shown with a floor plate, follower, and spring (104, 206, and 204 shown in FIG. 2, respectively) for description. It is to be noted that floor plate 104, follower 206, and spring 204 may be removable, as discussed above, for, for example, unloading magazine 700 or cleaning magazine 700. As shown in FIG. 7, cartridge magazine 700 is positioned such that a forward wall 718 is positioned at a topmost position on the page. Also illustrated are left wall 720, right wall 722, and rear wall 724 and base 712. In use cartridge may be inserted such that a bullet end of the cartridge is proximate to forward wall 718. As shown, a follower, such as follower 206 illustrated in FIG. 2, may ride in channel 716 and be connected to a floor plate 104, shown in FIG. 2, by spring 204, shown in FIG. 2.

As shown in FIG. 7, cartridge magazine 700 includes one or more ribs 702*a*-702*d*, which are similar in implementation and description to rib 426, shown in FIG. 4. For example, one or more ribs 702*a*-702*d* may be positioned vertically on right wall 722 of cartridge magazine 700. As shown in FIG. 7, a one or more ribs 702*a*-702*d* are shown, although any number of ribs may be implemented in practice. One or more ribs 702*a*-702*d* may be positioned along a vertical wall of cartridge magazine 700 beginning at a base 706 of the magazine or beginning below one or more ramps 708*a*-708*d* and extend vertically up and down cartridge magazine 700 to one or more ramps 708*a*-708*d*. One or more ribs 702*a*-702*d* may be rectangular, or square, and include a flat surface or top 704 which is the only portion of one or more ribs 702*a*-702*d* which should come into contact with cartridges during normal operation.

One or more ramps 708*a*-708*d* may be included at a top end of each one of one or more ribs 708*a*-708*d*. One or more ramps 703 are set at an angle to one or more ribs 702*a*-702*d* such that a cartridge that encounters one or more ramps 708*a*-708*d* in cartridge magazine 700 is pushed from a staggered stack to a single stack configuration at single stack portion 714 for loading at flat portion 710. Accordingly, one or more ramps 708*a*-708*d* serve to transition cartridges from a staggered stack configuration to a single stack configuration within cartridge magazine 700.

In practice, one or more ribs 702*a*-702*d* and one or more ramps 708*a*-708*d* may be spaced evenly along a vertical wall of cartridge magazine 700. Further, one or more ribs 702*a*-702*d* may extend along the vertical wall of cartridge magazine 700 from between a rim of a cartridge case and a neck of cartridge case such that each cartridge staggered to the side of cartridge magazine that includes one or more ribs 702*a*-702*d* contacts each rib along the case from between the rim of the cartridge case and the neck of the cartridge case (e.g., between a head and a shoulder of the cartridge case). One ramp 708*d* connected to the foremost rib 702*d* in cartridge magazine 700 may include a larger angle than other ramps 428 connected to other ribs 426 to accommodate constant contact with a shoulder of a cartridge case.

Figure 8:
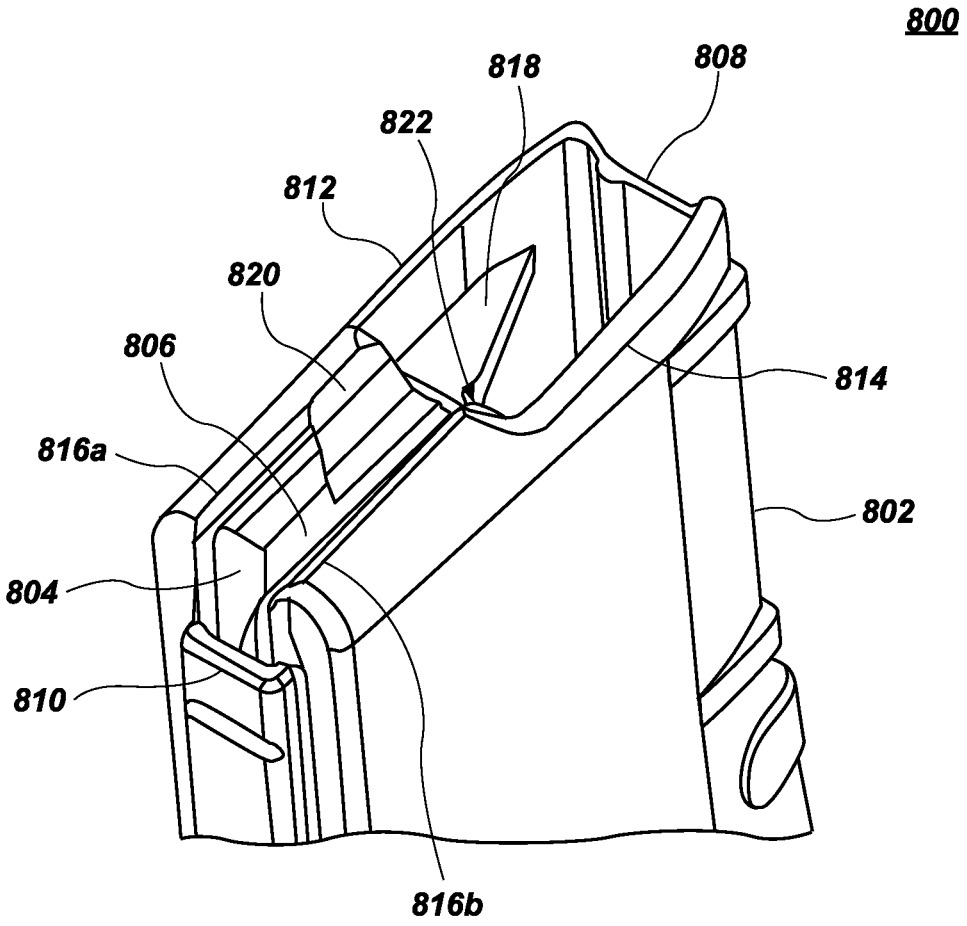
FIG. 8 illustrates a top perspective view of a cartridge magazine.

FIG. 8 illustrates a top perspective view of a cartridge magazine 800. Cartridge magazine 800 may include a body 801, comprising a front wall 808, a rear wall 810, a right wall 812, and a left wall 814. Cartridge magazine may be bounded on top by an opening that receives cartridges, the opening comprising a spacer 804 which provides a surface for flat portion 806, which is similar to flat portion 410 shown in FIG. 4 and discussed above. As previously discussed, spacer 804 may provide a space between flat portion 806 and left wall 814 that accommodates a single cartridge of a particular caliber at the opening.

The opening may further include feed lips 816*a* and 816*b* which facilitate receiving and retaining cartridges within cartridge magazine 800, respectively. Feed lips 816*a* and 816*b* extend far enough into the opening that cartridges may not be removed from cartridge magazine 800 vertically without first pushing cartridges forward, past an end of feed lips 816*a* and 816*b*. Further provided in the opening is a support 818 to support feed notch 820 and a top portion of ramp 822 (ramp 708*d*, shown in FIG. 7). Feed notch 820 facilitates loading of cartridges into cartridge magazine 800 as a part of feed lip 816*a*. When inserting cartridges, a head of a case may be inserted into feed notch 820 which allows a head of the case to slide under feed lip 816*b* to be retained in the magazine. Subsequent cartridges may be similarly installed. As mentioned, support 818 further provides a top end of ramp 822 (708 shown in FIG. 7) to provide a tapered top end that roughly conforms with a taper of a shoulder of a cartridge case, the portion of the cartridge case between a top of the body of the case and the neck. The shoulder of a cartridge case is also where a cartridge case is tapered to "neck down" a case intended for a larger bullet to a neck size that accommodates a smaller bullet. In other words, a tapered top end of ramp 822 approximately matches, within 10% in terms of taper angle, the taper of a shoulder of a cartridge case of a particular caliber. In this manner, cartridge magazine 800 provides an opening that accommodates a single stack portion (e.g., 714 shown in FIG. 7) of a magazine where cartridges in the magazine rest on each other, inline, with a zero degree offset.

The foregoing description has been presented for the purposes of illustration and description. It is not intended to be exhaustive or to limit the disclosure to the precise form disclosed. Many modifications and variations are possible in light of the above disclosure and teachings. Further, it should be noted that any or all of the aforementioned alternate implementations may be used in any combination desired to form additional hybrid implementations of the disclosure. For example, components described herein may be removed and other components added without departing from the scope or spirit of the embodiments disclosed herein or the appended claims.

Further, although specific implementations of the disclosure have been described and illustrated, the disclosure is not to be limited to the specific forms or arrangements of parts so described and illustrated. The scope of the disclosure is to be defined by the claims appended hereto, any future claims submitted here and in different applications, and their equivalents.

What is claimed is:

1. A cartridge magazine, comprising:

a front wall, a rear wall, a first side wall, a second side wall;

wherein the first sidewall includes a plurality of ribs extending longitudinally along the first sidewall, each one of the plurality of ribs terminating in one of a plurality of ramps, wherein one of the plurality of ramps is set at an angle that is larger than any other one of the plurality of ramps; and wherein one of the plurality of ramps tapers perpendicularly to a length of the rib.

2. The cartridge magazine of claim 1, wherein only the first sidewall includes the plurality of ramps.

3. The cartridge magazine of claim 1, wherein the one of the plurality of ramps that is set at an angle that is larger than any other one of the plurality of ramps is a ramp that is positioned as a closest ramp to the front wall.

4. The cartridge magazine of claim 1, wherein the one of the plurality of ramps that is set at an angle that is larger than any other one of the plurality of ramps is positioned in the cartridge magazine to contact a shoulder of an ammunition cartridge when an ammunition cartridge is disposed within the cartridge magazine.

5. The cartridge magazine of claim 4, wherein the one of the plurality of ramps that is set at an angle that is larger than any other one of the plurality of ramps orients a topmost ammunition cartridge when the ammunition cartridge is disposed within the cartridge magazine.

6. The cartridge magazine of claim 5, wherein the ammunition cartridge contacts the one of the plurality of ramps when the ammunition is disposed within the ammunition cartridge.

7. The cartridge magazine of claim 1, wherein the one of the plurality of ramps that is set at an angle that is larger than any other one of the plurality of ramps is connected to a support.

8. The cartridge magazine of claim 7, wherein the support is further connected to the first sidewall.

9. The cartridge magazine of claim 1, wherein a top of the one of the plurality of ramps is set at an angle that is larger than any other one of the plurality of ramps is tapered.

10. The cartridge magazine of claim 9, wherein the taper follows a taper of a shoulder of an ammunition cartridge which the cartridge magazine is sized to accept.

11. The cartridge magazine of claim 1, wherein the cartridge magazine positions each cartridge to have less than a 30 degree stagger angle.

12. The cartridge magazine of claim 1, wherein the cartridge magazine positions each cartridge to have less than a 60 degree stagger angle.

13. The cartridge magazine of claim 1, wherein the cartridge magazine includes a follower channel.

14. The cartridge magazine of claim 11, wherein the follower channel is disposed in the rear wall.

15. The cartridge magazine of claim 1, further comprising a removable floor plate.

16. The cartridge magazine of claim 15, further comprising a spring.

17. The cartridge magazine of claim 16, further comprising a follower.

18. The cartridge magazine of claim 17, wherein the spring pushes the follower towards a top of the cartridge magazine.

19. A cartridge magazine, comprising:

a wall which includes a plurality of ribs extending longitudinally along the wall, wherein, each one of the plurality of ribs terminating in one of a plurality of ramps, wherein one of the plurality of ramps is set at an angle that is larger than any other one of the plurality of ramps, and wherein one of the plurality of ramps tapers perpendicularly to a length of the rib.

20. The cartridge magazine of claim 19, wherein a top of the ramp tapers with a shoulder of an ammunition cartridge case which the cartridge magazine is sized to accept.

* * * * *